US012286809B2

(12) United States Patent
Barry et al.

(10) Patent No.: US 12,286,809 B2
(45) Date of Patent: Apr. 29, 2025

(54) RELOCATABLE TANK

(71) Applicant: ENTACON PTY LTD, Queensland (AU)

(72) Inventors: Shaun Edward Barry, Queensland (AU); Kieron Michael Jeffries, Queensland (AU)

(73) Assignee: ENTACON PTY LTD, Queensland (AU)

( * ) Notice: Subject to any disclaimer, the term of this patent is extended or adjusted under 35 U.S.C. 154(b) by 0 days.

(21) Appl. No.: 18/475,603

(22) Filed: Sep. 27, 2023

(65) Prior Publication Data

US 2025/0034895 A1 Jan. 30, 2025

(30) Foreign Application Priority Data

Jul. 27, 2023 (AU) ..... 2023902395

(51) Int. Cl.
*E04H 7/18* (2006.01)

(52) U.S. Cl.
CPC ..... *E04H 7/18* (2013.01)

(58) Field of Classification Search
CPC ..... E04H 7/18
USPC ..... 52/223.3, 245
See application file for complete search history.

(56) References Cited

U.S. PATENT DOCUMENTS 730,344 A * 6/1903 Clayton, Sr. ..... B65D 88/02 220/652
850,048 A * 4/1907 Playford ..... E04H 7/20 138/155
1,086,295 A * 2/1914 Hillman ..... E04H 7/20 52/610
2,684,173 A * 7/1954 Schmitz ..... B65D 90/12 220/648
3,456,835 A * 7/1969 Marcmann ..... B65D 90/06 52/249
3,648,303 A * 3/1972 Stewart ..... B65D 90/024 52/73
3,722,158 A * 3/1973 Dykmans ..... E04H 7/20 52/223.13
4,075,801 A * 2/1978 Alper ..... E04H 7/20 52/223.3

(Continued)

*Primary Examiner* — James J Buckle, Jr.
(74) *Attorney, Agent, or Firm* — Tarolli, Sundheim, Covell & Tummino LLP

(57) ABSTRACT

A relocatable tank, and method of constructing same, have a plurality of precast wall panels retained by a cable tensioning system between a plurality of support members to form a continuous, preferably generally circular, wall. At least some of the support members comprise at least one aperture and at least one elongate slot to receive respective cables of the tensioning system to retain a shape of the tank. The tank can be easily assembled at a site with prefabricated parts and easily deconstructed when no longer needed and be relocated and reinstalled in a range of sizes if desired. The relocatable tank is typically installed on a compacted earthen pad with no requirement for a concrete footing, unless the tank is used in regions with high seismic or wind activity. A liner system comprised of either a single or double arrangement is installed to fluidly seal the tank. The inclusion of water ballast tubes means no minimum liquid level is required to secure the liner in a designated position.

27 Claims, 14 Drawing Sheets

(56) References Cited

U.S. PATENT DOCUMENTS

| | | | | | |
|---|---|---|---|---|---|
| 4,122,640 | A * | 10/1978 | Commins | B65D 90/06 | 52/249 |
| 4,163,347 | A * | 8/1979 | Marcmann | B65D 90/06 | 403/166 |
| 4,207,716 | A * | 6/1980 | Moldrup | E04H 7/20 | 52/223.3 |
| 4,267,676 | A * | 5/1981 | Marchaj | E04H 7/02 | 52/223.3 |
| 4,338,756 | A * | 7/1982 | Crothers | E04B 1/762 | 52/573.1 |
| 4,534,490 | A * | 8/1985 | McBride | B65D 90/06 | 52/249 |
| 4,555,883 | A * | 12/1985 | Agsten | E04H 7/18 | 52/248 |
| 6,663,825 | B2 * | 12/2003 | Grant, Jr. | C21C 5/445 | 266/271 |
| 10,538,384 | B2 * | 1/2020 | Crowther | E04H 7/18 | |
| 10,550,565 | B2 * | 2/2020 | Heatly | E04C 2/38 | |
| 11,235,923 | B2 * | 2/2022 | Polacek | B65D 90/205 | |
| 2013/0180996 | A1 * | 7/2013 | Lee | B23P 11/00 | 220/592.24 |
| 2014/0144916 | A1 * | 5/2014 | Jeffries | E04H 7/20 | 29/428 |
| 2016/0152411 | A1 * | 6/2016 | Corbeil | B65D 88/748 | 220/4.12 |

* cited by examiner

SECTION AT SUMP

SECTION AT INLET PIPEWORK

SECTION AT OUTLET PIPEWORK

RELOCATABLE TANK

FIELD OF THE INVENTION

The invention relates to a relocatable tank and a method of assembling a relocatable tank. In particular, the invention relates, but is not limited, to a modular, relocatable liquid storage tank erectable on a site with a plurality of demountable precast concrete panels, steel posts and post tensioning cables.

BACKGROUND TO THE INVENTION

Tanks of various shapes and sizes are known for storing fluids, in particular liquids, such as water. Such tanks vary in size tremendously from, for example, a personal water storage tank for drinking or irrigation purposes to industrial or commercial storage tanks. Small tanks are relatively easy to assemble and can often be moulded as a single piece (e.g. 1-50 kL water storage tanks). However, as tank sizes increase it becomes increasingly more difficult to construct a sealed tank for storing fluid.

One of the issues with constructing large tanks is in transporting and building the tank, particularly for remote locations. For example, in mining, oil, and gas applications, water is a common by-product which may be processed and/or stored in tanks, or reservoirs, or the like. The storage of these liquids in the tanks may be long term or temporary. In any event, often the well or mine site is in a remote location with limited infrastructure and building a tank requires significant preparation and logistics.

Large tanks often suffer from hoop stress and, when empty, wind loading. Furthermore, the walls of the tank may need to be reinforced with an external structure. For example, the walls of the tank may be reinforced with a frame. Such a frame typically has support members which extend radially outwards from the tank walls. In one tank design, the support members are steel 'A'-frame members. Disadvantageously, such supporting framework requires additional space around the tank walls. As the support members need to be provided with suitable support, the concrete pad or footing also needs to be large enough to extend to at least the outer edge of the framework, further increasing costs and environmental impact of the tank.

Typically, the foundation area for a tank requires civil preparation including grading, compaction and a concrete pad for the entire tank and a foundation for the walls. A particular tank design involves an annual concrete foundation underneath the perimeter of the tank. The walls area erected on the foundation or pad. As such considerable costs and time are required to prepare the site and wall foundation.

Consequently, at the end of service the tanks need to be decommissioned and site remediated. This would involve excavation and disposal of the concrete foundation and pad which is costly and time consuming not to mention the creation of additional greenhouse gas emissions. Similarly, an earthen reservoir requires significant civil preparation and remediation.

Furthermore, the cost of fixed storage tanks is multiplied when the location requirement for the storage tank changes, as is often the case in mining, gas and industrial applications.

Also due to the fixed nature of earthen ponds and traditional tank structures, the approval, design, procurement and construction phases are long and arduous.

At least some of the aforementioned problems have been addressed by demountable tanks disclosed in international patent publication number WO2012/142661. Such demountable tanks comprise a wall defined by a plurality of panels which are retained by opposed side edges between adjacent support members. The support members have a base portion and a support portion and are free-standing on the base portion on an earthen floor allowing the tank to be constructed at sites without concrete foundations such as a concrete pad or ring. However, the demountable tanks disclosed in this application still have limitations on the size of tank achievable.

Another problem encountered with larger tanks is the additional tensioning force required for larger tanks, which increases the inward pressure concentrated at tensioning posts. This can cause inversion of several panels either side of the tensioning post and compromise the circular integrity of the tank.

Another problem known with prior art tanks is where a liner is deployed to seal the tank and retain the liquid. The liner is susceptible to damage and movement if a minimum liquid level is not maintained in the tank to provide sufficient weight to prevent liner movement due to wind. This reduces the available operating capacity of the tank and for remote locations and areas of high evaporation this minimum water level cannot always be guaranteed.

Another complication with earthen storage tanks revolves around the specific material composition and properties for lining the earthen dam which if not readily available on site can add significant costs and time to a construction when it needs to be transported in.

Reference to background art herein is not to be construed as an admission that such art constitutes common general knowledge.

OBJECT OF THE INVENTION

It is a preferred object of this invention to provide a relocatable tank which overcomes or at least ameliorates one or more of the disadvantages or problems described above, and/or which at least provides a useful alternative.

Other preferred objects of the present invention will become apparent from the following description.

SUMMARY OF INVENTION

In one form, although it need not be the only or indeed the broadest form, there is provided a relocatable tank comprising:

- a plurality of support members arrangeable in a spaced apart configuration along a perimeter of the tank;
- a plurality of precast wall panels arrangeable between, and received at least partially within the plurality of support members to form a continuous wall along the perimeter of the tank; and
- a tensioning system comprising a plurality of cables configured to extend around an outside of the continuous wall;
- wherein at least some of the support members comprise at least one aperture and at least one elongate slot to receive respective cables of the tensioning system to retain a shape of the tank.

Suitably, the wall panels: are precast concrete panels; and/or are substantially planar; and/or are pre-stressed; and/or have side walls at a transverse angle to the plane of the panel.

Suitably, the side walls are angled in opposite directions to form an isosceles trapezoid in a cross-section of the wall panel.

Suitably, the support members comprise standard support members and tensioning support members.

Preferably, the support members comprise an I-beam attached to a base portion, the I-beam comprising a central portion and substantially perpendicular flanges coupled to ends of the central portion, wherein the wall panels are received between the flanges of the I-beam.

Preferably, the support member in the form of the tensioning support member comprises at least one aperture in the central portion thereof and at least one elongate slot in the central portion thereof.

Preferably, the at least one elongate slot comprises a channel extending into at least one of the substantially perpendicular flanges to receive a cable therein.

Preferably, the support member in the form of the tensioning support member comprises a plurality of apertures in the central portion thereof and a plurality of elongate slots below said apertures.

Preferably, the support member in the form of the tensioning support member comprises a plurality of elongate slots above said apertures, said elongate slots below said apertures being of a greater depth than the elongate slots below the apertures.

Preferably, the at least one elongate slot comprises a substantially horizontal portion extending from at least one of the flanges coupled to a substantially vertical portion extending downwardly in the central portion of the tensioning support member.

Preferably, the apertures in a first type of the tensioning support member are vertically offset with respect to the apertures in a second type of the tensioning support member.

In some embodiments, a plurality of cables collectively extends around the continuous wall. In particular, the tensioning cables may be in greater concentration towards the base of the panels, or in a lower portion of the panels.

In some embodiments, at least one of the tensioning support members is provided for at least every quarter of a circular tank. Suitably, at least one of the tensioning support members and at least one of the standard support members are provided in a group periodically around a perimeter of a circular tank.

Preferably, at least one cable anchor or at least one retention bar is provided to retain one or more of the cables at the support member.

Preferably, a first type of the tensioning support member comprises a plurality of spaced apart cable anchors which are vertically offset with respect to a plurality of spaced apart cable anchors of a second type of the tensioning support member.

The relocatable tank may further comprise at least one liner configured to fluidly seal the wall panels and a floor of the relocatable tank. Suitably, the liner may be a double liner.

The relocatable tank may further comprise a leak detection system and the leak detection system may comprise a leak detection layer fluidly connected to an outlet.

Suitably, the outlet is a sump having a height greater than the continuous wall with a pump configured to return fluid from the sump back into the relocatable tank or discharged elsewhere.

The relocatable tank may further comprise one or more water ballast tubes inside the perimeter of the tank to retain the at least one liner, for example, when there is insufficient liquid in the tank to do so.

In some embodiments, a portion of the floor of the tank inside the perimeter of the tank slopes towards the wall of the tank.

The relocatable tank may further comprise an overflow arrangement, such as a weir situated near the top of one of the panels and/or a floating cover.

In another form, there is provided a method of assembling a tank on a site, the method comprising the steps of:

- erecting a plurality of support members in a spaced apart configuration along a perimeter of the tank, wherein at least some of the support members comprise at least one aperture and/or at least one open ended elongate slot;
- erecting a plurality of precast wall panels between, and received at least partially within the plurality of support members to form a continuous wall along the perimeter of the tank; and
- substantially surrounding an outside of the continuous wall with a plurality of cables of a tensioning system received within the at least one aperture and/or the at least one elongate slot of the support members to retain a shape of the tank.

Suitably, the tank assembled by the method comprises one or more of the aforementioned features of the tank and/or one or more of the features of the tank as described herein.

Further features and advantages of the present invention will become apparent from the following detailed description.

BRIEF DESCRIPTION OF THE DRAWINGS

By way of example only, preferred embodiments of the present invention will be described more fully hereinafter with reference to the accompanying figures, wherein.

Figure 1:
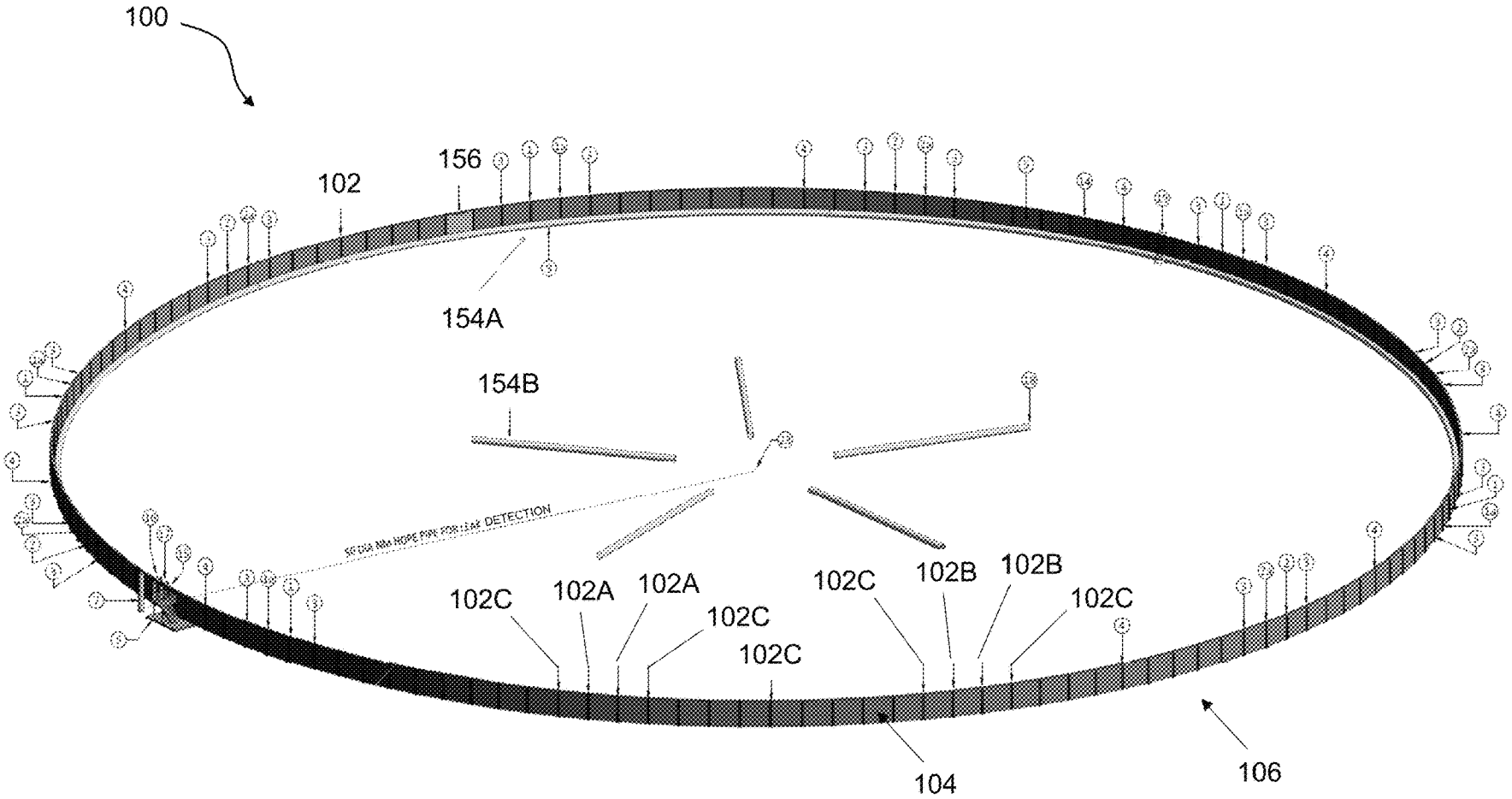
FIG. 1 illustrates a perspective view of a relocatable tank in accordance with embodiments of the present invention.

Skilled addressees will appreciate that elements in the drawings are illustrated for simplicity and clarity and have not necessarily been drawn to scale. For example, the relative dimensions of some elements in the drawings may be distorted to help improve understanding of embodiments of the present invention. Embodiments of the present invention may be represented schematically and/or the drawings may omit one or more features for the sake of clarity.

DETAILED DESCRIPTION OF THE DRAWINGS

Figure 2:
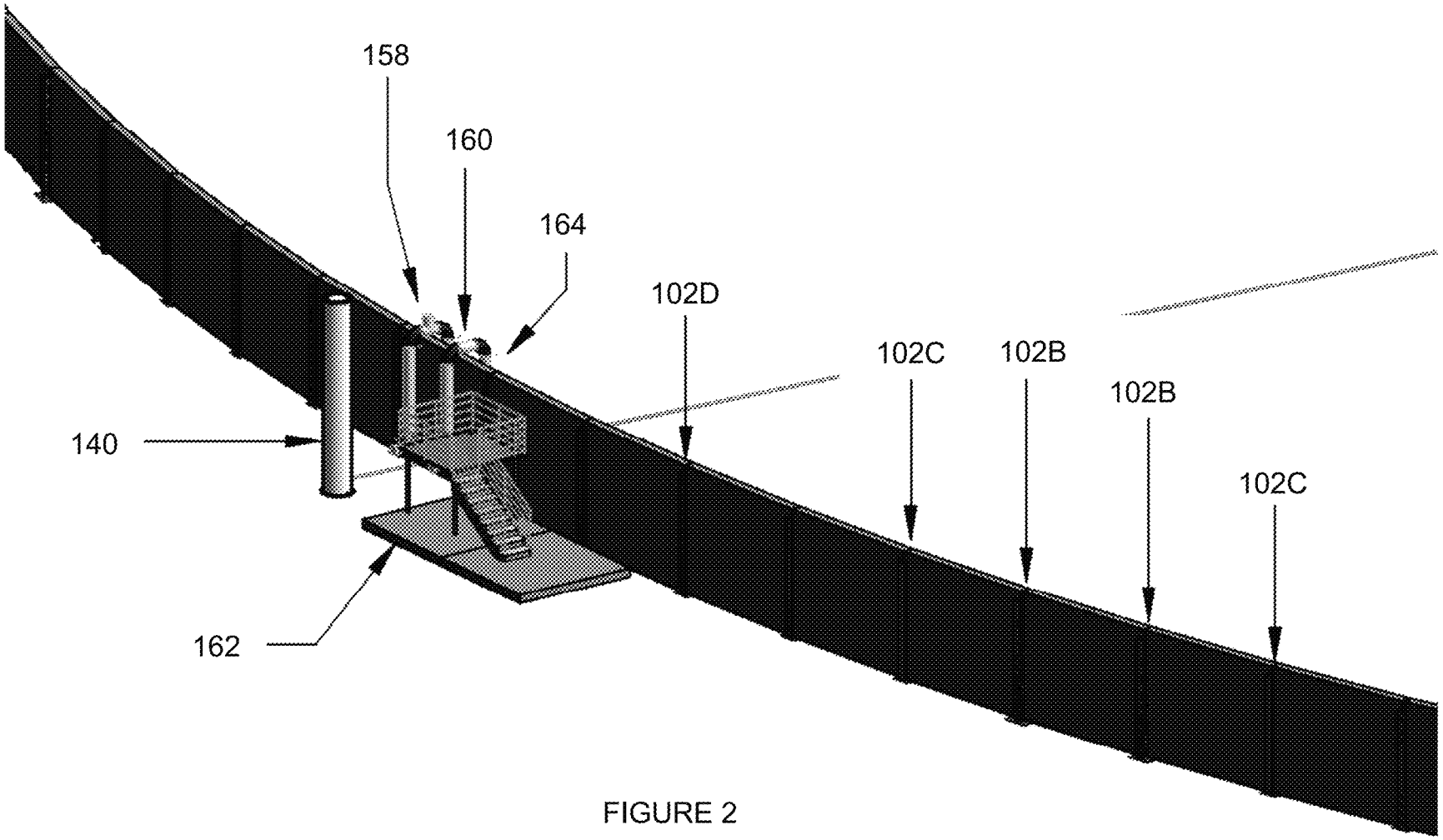
FIG. 2 is an enlarged perspective view of a portion of the relocatable tank shown in FIG. 1.

FIG. 1 illustrates a relocatable tank 100 according to some embodiments of the present invention, with an enlarged section of the tank 100 shown in FIG. 2. Relocatable tank 100 comprises a plurality of support members 102 arrangeable in a spaced apart configuration along a perimeter of the tank. Relocatable tank 100 also comprises a plurality of precast wall panels 104 arrangeable between and received at least partially within the plurality of support members 102 to form a continuous wall 106 along the perimeter of the tank. Relocatable tank 100 comprises a tensioning system 108 (shown in FIGS. 3-13) comprising a plurality of cables 110 configured to extend around an outside of the continuous wall 106. With reference to FIGS. 5-11 in particular, at least some of the support members 102 comprise at least one aperture 112 and at least one elongate slot 126A-D to receive respective cables of the tensioning system to retain a shape of the tank 100.

Preferred embodiments of the relocatable tank 100 comprise different types of support members such as standard support members and tensioning support members, preferably arranged in specific groupings, which will be described in further detail herein along with the tensioning system 108.

For many applications, the wall panels 104 are in the form of precast concrete panels. In some embodiments, the panels are pre-stressed comprising reinforcing elements. For many applications, the panels 104 are substantially planar, which facilitates ease of manufacture of the panels, yet still allow circular tanks to be constructed due to the size of the tank. For many applications, the panels 104 have side walls 116 at a transverse angle to the plane of the panel. However, in some embodiments, the side walls 116 are angled in opposite directions to form an isosceles trapezoid in a cross-section of the wall panel 104. Therefore, in some embodiments, the side wall 116 can be between 0° and 22.5° to an orthogonal axis of the plane of the wall panels 104.

Figure 3:
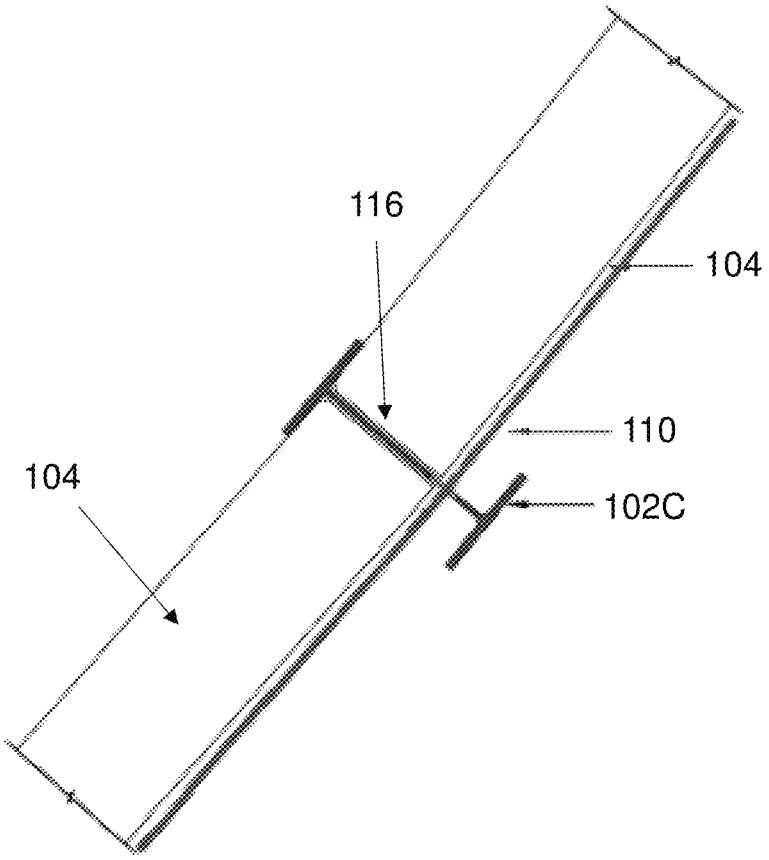
FIG. 3 is a cross sectional plan view of adjacent wall panels of the relocatable tank and a standard support member.
Figure 4:
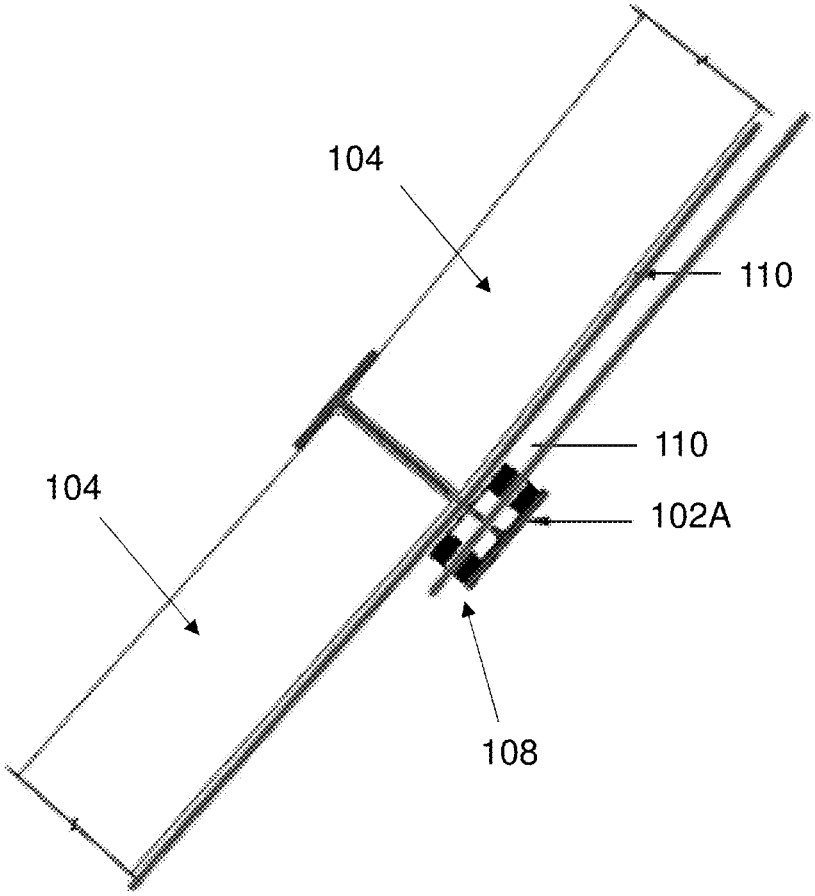
FIG. 4 a cross sectional plan view of adjacent wall panels of the relocatable tank and a tensioning support member.

With reference to FIGS. 3 and 4, a plurality of precast wall panels 104 are arranged adjacent one another to form a substantially circular continuous wall 106 with the support members 102 in between each panel. The planar panels 104 each form a circle segment. The number of panels used will depend on the size of the tank. The tank 100 illustrated in FIG. 1 comprises approximately 152 wall panels 104, but clearly the invention is not limited to the number of wall panels 104. Once the wall 106 has been erected the panels 104 are retained by the tensioning system 108 whereby post stress cables 110 are run externally through the apertures 112 in the support members 102 and anchored at specifically placed tensioning support members. Temporary props (not shown) can be used to support the wall panels 104 and once the tensioning cables 110 are in place the props can be removed and the continuous wall 106 is self-standing. The cable tensioning system 108 retains the wall panels 104 in such an arrangement and provides support such that the wall panels cannot fall outward. In use, liquid contained in the tank 100 provides radial forces against the wall panels 104. The tensioning system must therefore be of sufficient strength to not just hold the wall panels 104 in place in a freestanding manner, but also to be able to withstand the radial forces exerted by the liquid contained therein.

Figure 10:
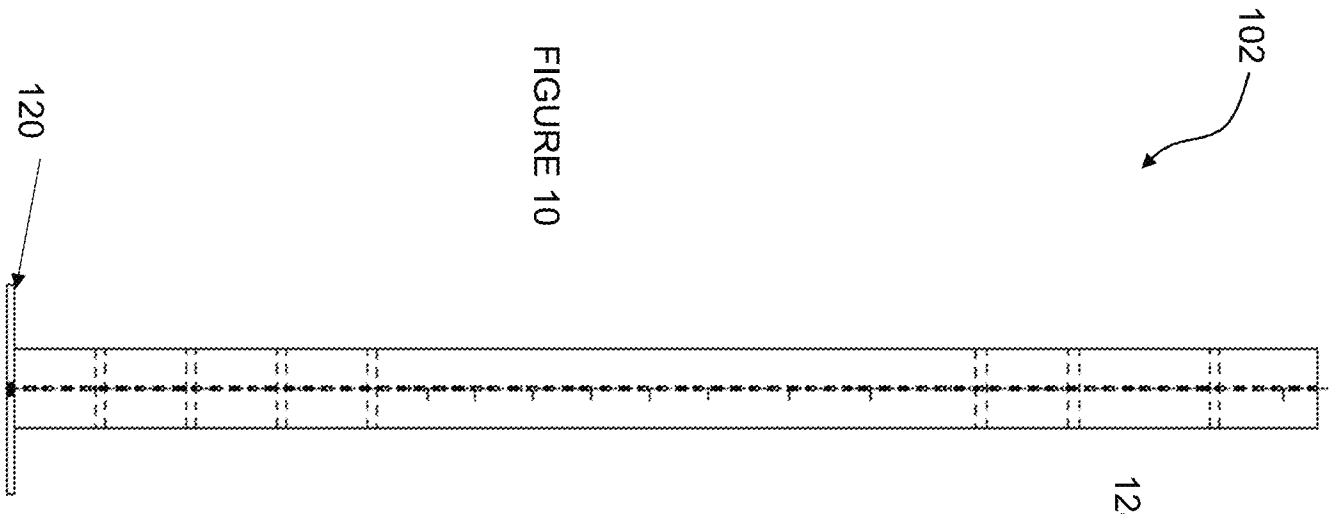
FIG. 10 is a side view of the standard support member shown in FIG. 9.
Figure 9:
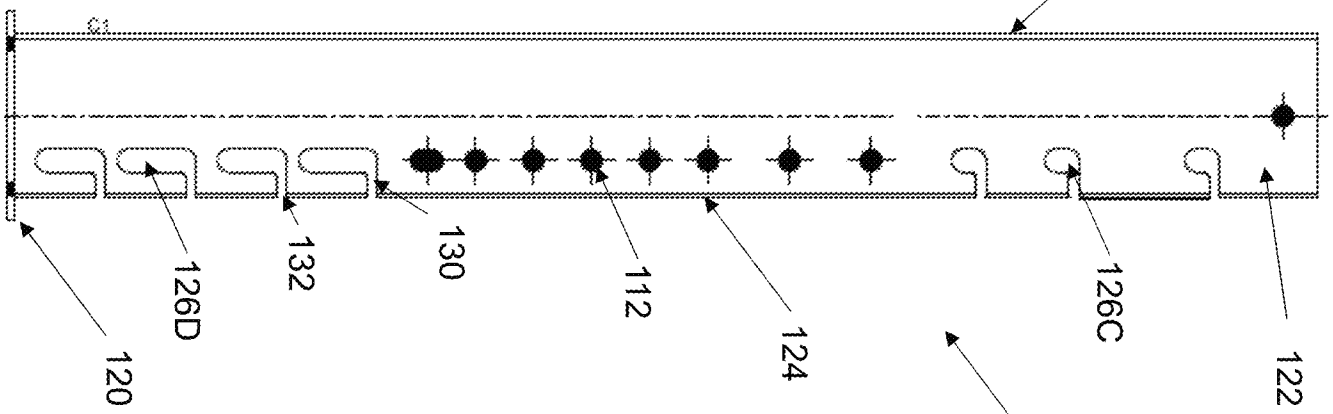
FIG. 9 is a front view of the standard support member shown in FIG. 4.
Figure 11:
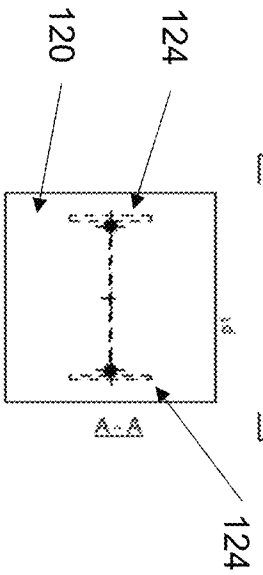
FIG. 11 is a cross sectional underside view of the tensioning support member shown in FIG. 9.

With further reference to FIGS. 9 to 11, in preferred embodiments, the support members 102 comprise an I-beam 118 attached to a base portion 120. The I-beam 118 comprises a central portion or web 122 and substantially perpendicular flanges 124 coupled to ends of the central portion or web 122. As shown most clearly in FIGS. 3 and 4, the wall panels 104 are received between the flanges 124 of the I-beam.

In accordance with preferred embodiments of the present invention, different types of the support members 102 are provided with a variety of features and comprise so-called standard support members and tensioning support members which will be described with reference to FIGS. 5 to 12.

Figure 5:
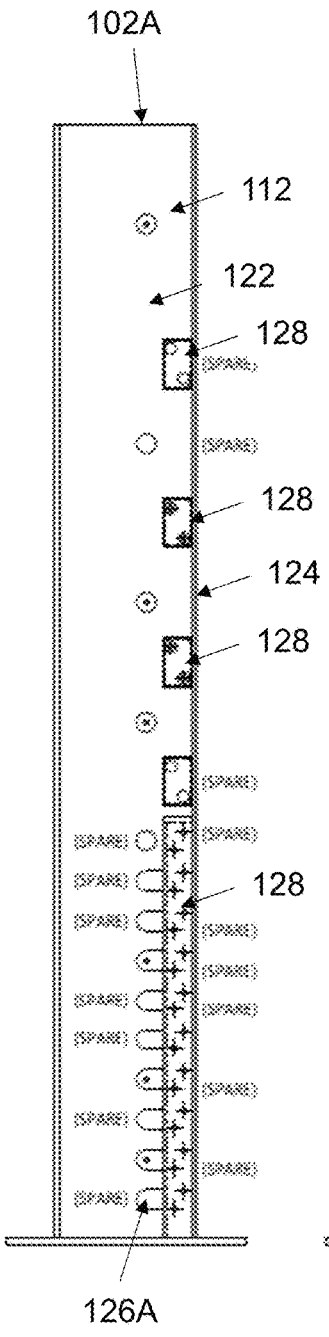
FIG. 5 is a front view of the tensioning support member shown in FIG. 4.

With reference to FIG. 5, some of the support members are in the form of the tensioning support members 102A which comprise at least one aperture 112 in the central portion 122 thereof and at least one elongate slot 126A in the central portion 112 thereof. In the embodiment shown in FIG. 5, the tensioning support member 102A comprises a plurality of spaced apart generally circular apertures 112 in an upper region of the central portion 122 thereof and a plurality of spaced apart elongate slots 126A extending substantially horizontally in a lower region of the central portion 112 thereof and below the apertures 112. The plurality of elongate slots 126A are provided in a greater frequency in the lower region of the central portion 112 of the tensioning support member 102A than the apertures 112 in the upper region. In this example, five apertures 112 are provided in the upper region and nine elongate slots 126A are provided in the lower region.

The tensioning support member 102A comprises at least one anchor block 128 to retain and secure the tensioning cables 110. In the embodiment shown in FIG. 5, the tensioning support member 102A comprises a plurality of anchor blocks 128. In this example, anchor blocks 128 are provided in the upper region of the central portion 122 offset from the positions of the apertures 112. In particular, anchor blocks 128 are both vertically and horizontally offset from the positions of the apertures 112. In FIG. 5, anchor blocks 128 are below the positions of the apertures 112 and abutting one of the flanges 124 of the I-beam of the tensioning support member 102A. In this example, the tensioning support member 102A also comprises an anchor block 128 spanning the elongate slots 126A and abutting the same flange 124.

Figure 6:
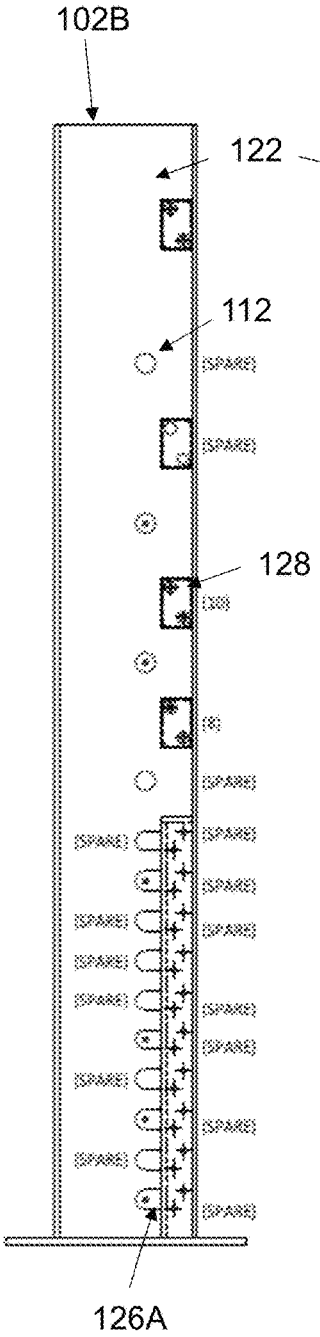
FIG. 6 is a front view of a variation of the tensioning support member shown in FIG. 4.

FIG. 6 shows another example of one of the support members in the form of a tensioning support member 102B having a similar configuration to the tensioning support member 102A. Tensioning support member 102B comprises a plurality of apertures 112 in the central portion 122 which are vertically offset from the positions of the apertures 112 in the tensioning support member 102A. For example, four of the apertures 112 are at higher positions of the central portion 122 of tensioning support member 102B compared with tensioning support member 102A. Generally, the elongate slots 126A are in the same locations in the lower region of tensioning support member 102B compared with tensioning support member 102A.

The tensioning support member 102B comprises at least one anchor block 128 to retain and secure the tensioning cables 110. In the embodiment shown in FIG. 6, the tensioning support member 102B comprises a plurality of anchor blocks 128 provided in the upper region of the central portion 122 offset from the positions of the apertures 112 in the tensioning support member 102B. In particular, the anchor blocks 128 are vertically and horizontally offset from the apertures 112. The anchor blocks 128 are also offset from the positions of the anchor blocks 128 of the tensioning support member 102A. In particular, anchor blocks 128 of the tensioning support member 102B are above the positions of the apertures 112 of the tensioning support member 102B. In this example, the tensioning support member 102A also comprises an anchor block 128 spanning the elongate slots 126A.

Figure 7:
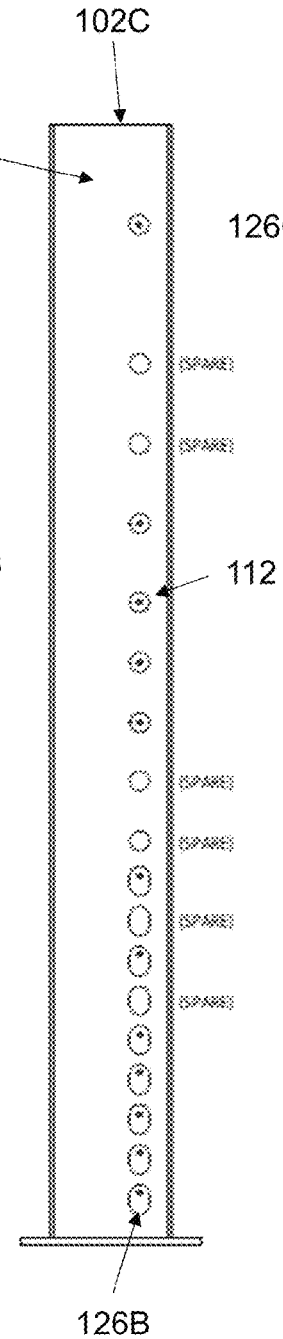
FIG. 7 is a front view of the standard support member shown in FIG. 3.

With reference to FIG. 7, some of the support members are in the form of the standard support members 102C which comprise at least one aperture 112 in the central portion 122 thereof. In the embodiment shown in FIG. 7, the standard support member 102C comprises a plurality of spaced apart apertures 112 comprising a plurality of generally circular apertures 112 in an upper region of the central portion 122 and a plurality of elongate slots 126B extending substantially vertically in a lower region of the central portion 112. In this example, nine apertures 112 are provided in the upper region and nine elongate slots 126B are provided in the lower region.

Figure 8:
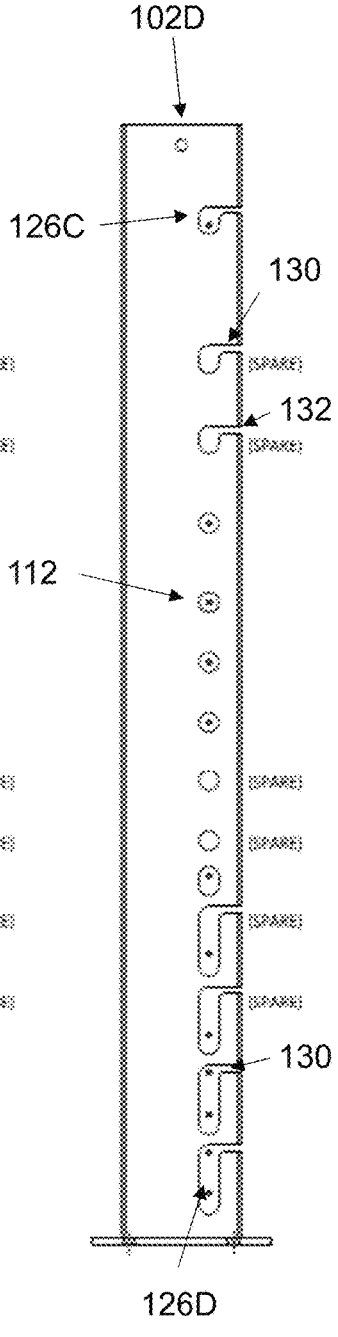
FIG. 8 is a front view of a variation of the standard support member shown in FIG. 3.

FIG. 8 shows another example of one of the support members in the form of a standard support member 102D which comprises at least one aperture 112 in the central portion 122 thereof. In the embodiment shown in FIG. 8, the standard support member 102D comprises a plurality of spaced apart apertures 112 comprising a plurality of generally circular apertures 112 in a central region of the central portion 122 and a plurality of elongate slots 126C in an upper region and a plurality of elongate slots 126D in a lower region of the central portion 112. The elongate slots 126C, 126D in the upper region and in the lower region of the central portion 112 extend substantially vertically. The depth of the elongate slots 126D in the lower region below the circular apertures 112 is greater than the depth of the elongate slots 126C above the apertures 112. The greater depth allows multiple cables 110 to be received therein. In this example, three elongate slots 126C are provided in the upper region and the lower region comprises one elongate slot 126B and four elongate slots 126D. The central region of the central portion 122 comprises six generally circular apertures 112. Although not shown, standard support member 102D comprises one at least one retention bar to retain one or more of the cables 110.

In the embodiment shown in FIG. 8, the substantially vertical elongate slots 126C in the upper region and the substantially vertical elongate slots 126D in the lower region of the central portion 122 comprise a substantially horizontal channel 130 extending to one of the flanges 124 thus creating an open end 132 to receive one or more cables 110 therein.

FIGS. 5 to 8 in particular illustrate the alignment of generally circular apertures 112, elongate slots 126A, 126B, 126C, 126D and anchor blocks 128 across the tensioning support members 102A, 102B and the standard support members 102C, 102D. Such configurations of the support members increase the flexibility of routing cables 110 around the outside of the tank 100 according to the different requirements of tanks of different sizes, and in particular the requirements of very large tanks. For example, a wide variety tank sizes can be constructed with just the four different support members 102A-D shown in FIGS. 5 to 8.

In FIGS. 5 to 8 some of the apertures 112 and some of the elongate slots 126A-D comprise one or more dots indicating the presence of one or more tensioning cables 110, respectively. Some of the anchor blocks 128 comprise crosses indicating the presence of a tensioning cable 110 anchored or retained therein. Some of the apertures 112, elongate slots 126A-D and anchor blocks 128 comprise the notation (SPARE) indicating that that they are not accommodating a tensioning cable 110 in this particular configuration. For different tank sizes, more or fewer apertures 112, elongate slots 126A-D and/or anchor blocks 128 can accommodate cables 110 depending on the requirements of the tank.

Hence, in some embodiments, a plurality of tensioning cables 110 collectively extends around the outside of the continuous wall 106. In particular, the tensioning cables 110 may be in greater concentration towards the base of the panels 104, or in a lower portion, as indicated by the higher number of elongate slots 126A, 126B and 126D and anchor blocks 128 in the lower regions of the support members 102A-D.

In some embodiments, at least one of the tensioning support members 102A, 102B is provided for at least every quarter of a circular tank.

In some embodiments, at least one of the tensioning support members 102A, 102B and at least one of the standard support members 102C, 102D are provided in a group periodically around a perimeter of a circular tank.

In some embodiments, at least two of the tensioning support members 102A, 102B and at least two of the standard support members 102C, 102D are provided in a group periodically around a perimeter of a circular tank. With reference to FIG. 1, one group of support members comprises a standard support member 102C, followed by two tensioning support members 102A, followed by a standard support member 102C. Another group of support members comprises a standard support member 102C, followed by two tensioning support members 102B, followed by a standard support member 102C. In between these two groups of support members, a plurality of standard support member 102C is provided. This sequence of support members is repeated about the perimeter of the circular tank shown in FIG. 1.

Figure 12:
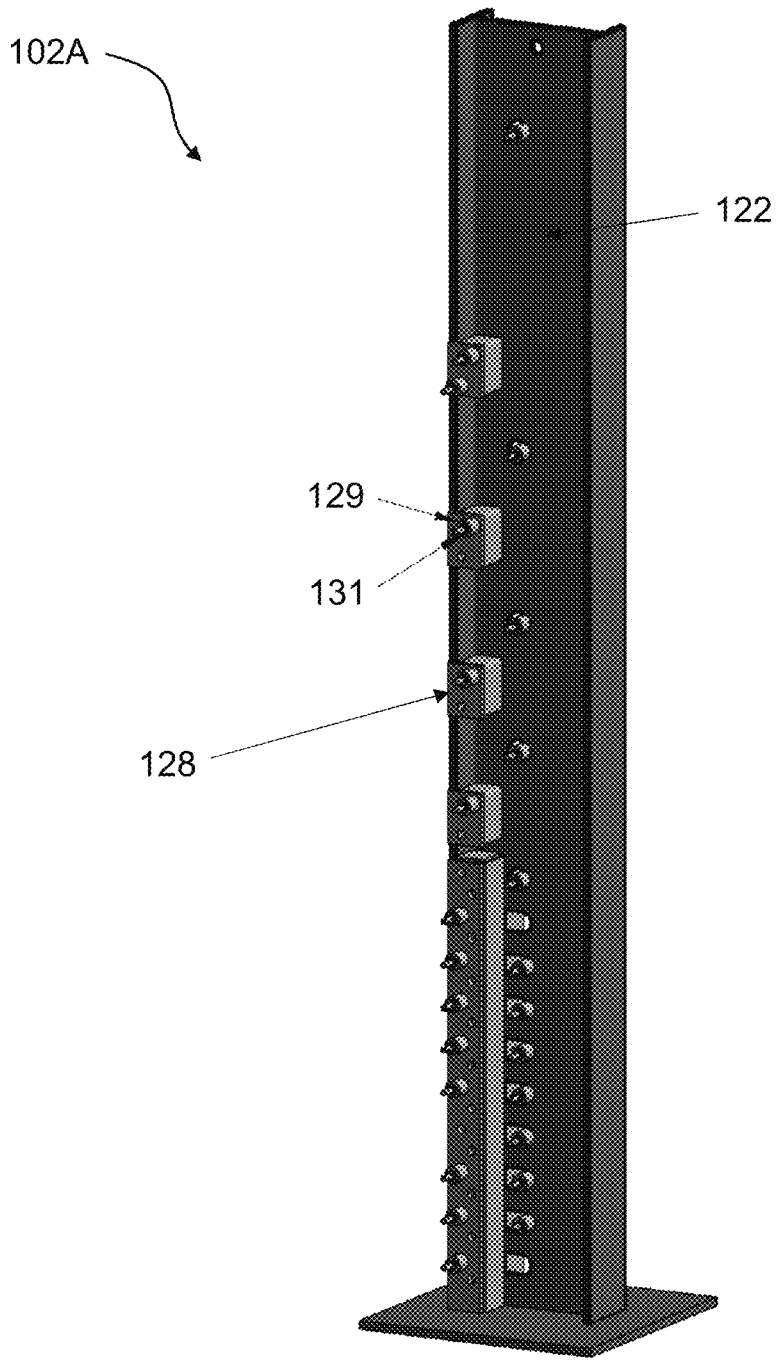
FIG. 12 is a perspective view of the tensioning support member shown in FIG. 5 comprising cable anchors.

As shown in FIG. 12 the tensioning support member 102A, 102B is configured to accept one or more post tensioning cables 110 and provide anchor points for the post tensioning system. Anchor blocks 128 are installed over the ends of the cables 110 to be secured through a barrel 129 in the anchor block 128. Wedges 131 secure the cable 110 in the anchor block 128 and tensioning equipment (not shown) is utilised to draw the cables 110 through respective anchor blocks 128 to achieve sufficient tension in the cables 110 which are subsequently held in place by the wedges 131.

Figure 13:
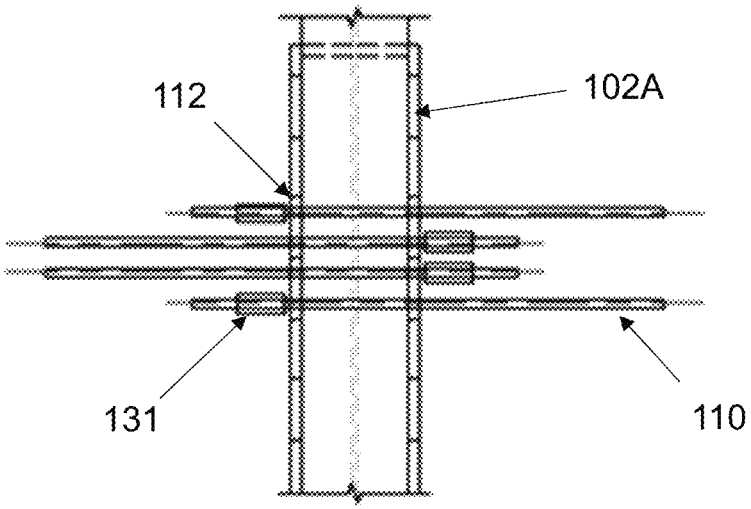
FIG. 13 is a sectional view showing an arrangement of cables at one of the tensioning support members shown in FIG. 5.

FIG. 13 shows an example of an arrangement of cables 110 at one of the tensioning support members 102A shown in FIG. 5. When the tensioning support members 102A are configured in pairs, the cables 110 are passed through apertures 112 and retained and tensioned on one side of each of the tensioning support members 102A in an alternating sequence at anchor blocks 128. This configuration ameliorates the force distribution from the cable tensioning system and the problem of inversion of the panels 104 is prevented. Where single tensioning support members are used tensioning cables 110 can be anchored on both sides of the tensioning support member 102A, 102B.

Since the volume of liquid increases with the size of the tank, so does the amount of cable required to apply tension to withstand the additional forces. The configuration of the circular apertures 112, elongate slots 126A, 126B, 126C, 126D and anchor blocks 128 in the support members of the present invention enable the support members to accommodate an increased number of cables to be run around the circumference of the tank compared with at least some of the prior art and an increased flexibility in their arrangement as required by the size of the tank. For example, fewer of the apertures 112, elongate slots 126A-D and/or anchor blocks 128 will have the notation (SPARE) as the size of the tank increases. The additional tension required for larger tanks increases the inward pressure concentrated at the tensioning posts. This can cause inversion of several panels either side of the tensioning post and compromise the circular integrity of the tank. To ameliorate this force transfer some embodiments of the present invention duplicate the tensioning support members 102A, 102B periodically around the perimeter of the tank as described herein thus splitting the anchoring points between two tensioning support members. This distributes the force and reduces the force on each tensioning support member and eliminating the inversion movement. This advancement enables significantly larger diameter tanks to be constructed accommodating volumes >50 ML. Additionally, installation of the cables 110 into the slots is simpler as the cables 110 can be dropped into the slots instead of being fed through a hole. Not only does this reduce construction time but also reduces the manual labour component.

Figure 14:
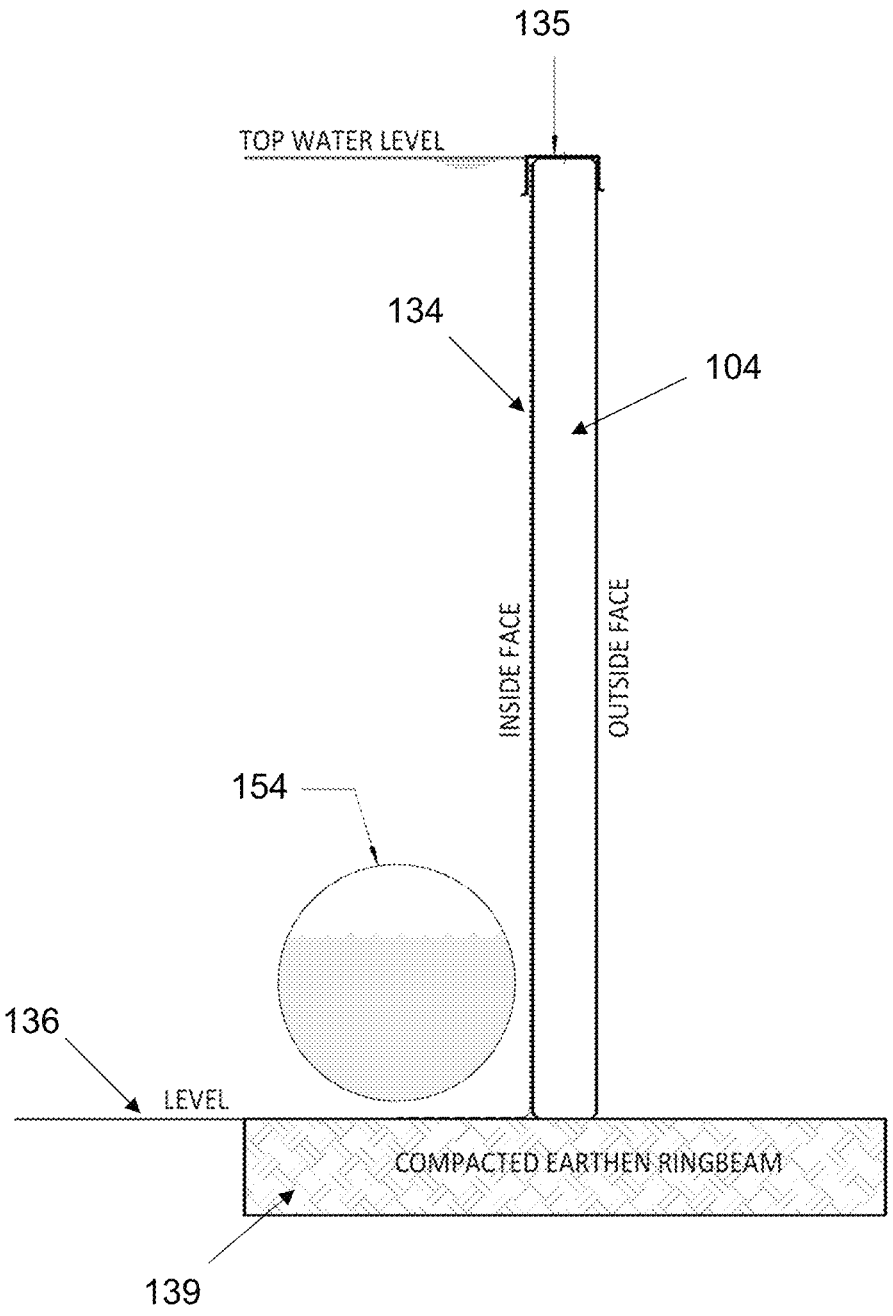
FIG. 14 is a cross sectional side view of the relocatable tank showing a typical arrangement for panels erected on earthen ring beam, liner system, capping, and water tube ballast.
Figure 15:
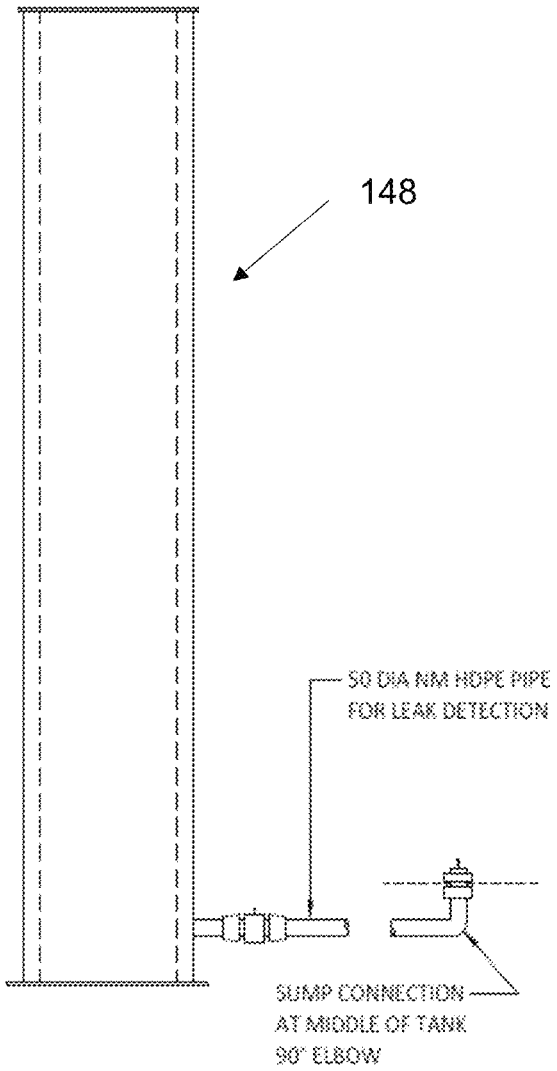
FIG. 15 is a cross sectional view of a sump of the relocatable tank.
Figure 16:
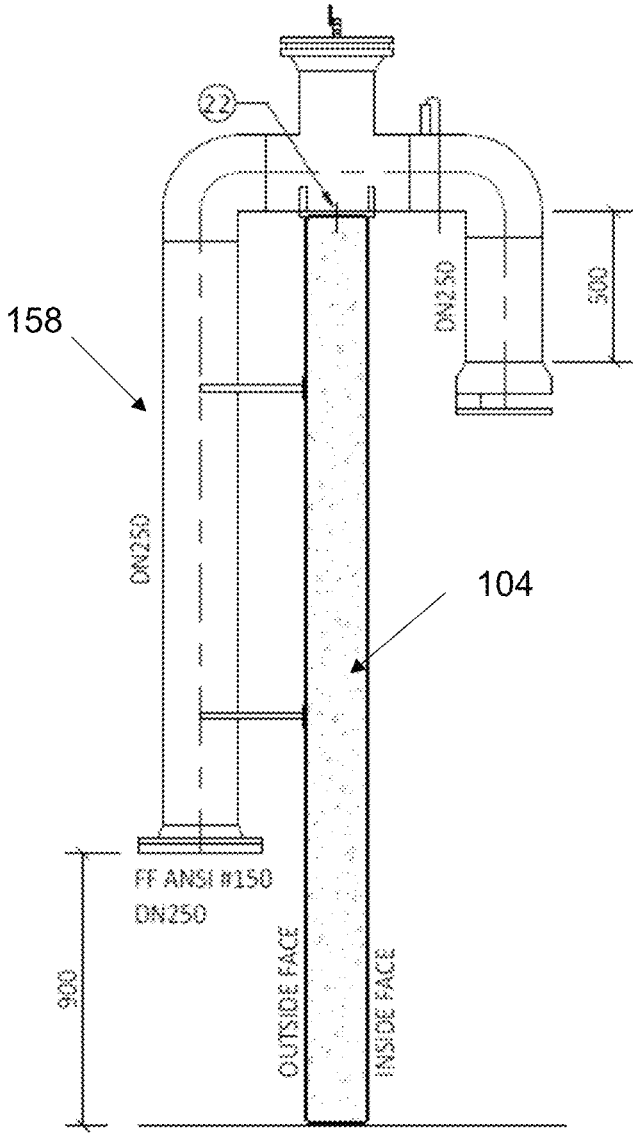
FIG. 16 is a cross sectional view of inlet pipework of the relocatable tank.
Figure 17:
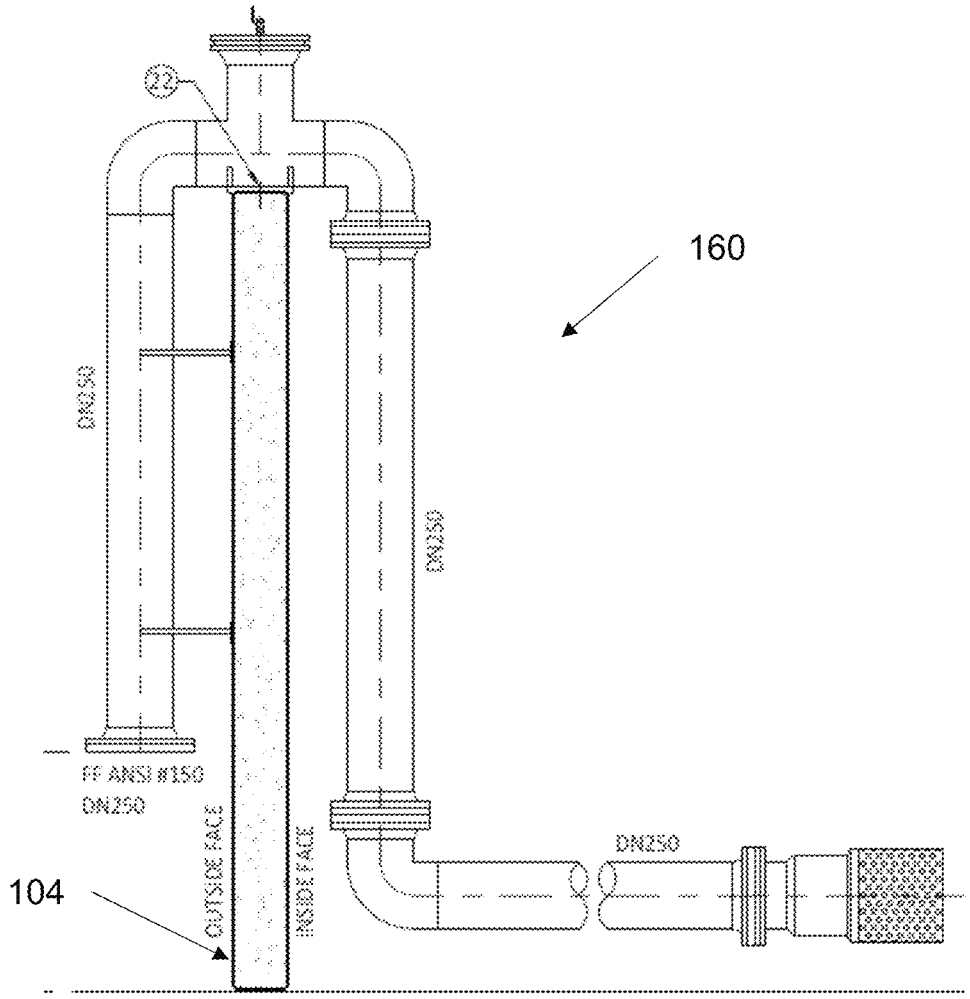
FIG. 17 is a cross sectional view of outlet pipework of the relocatable tank.
Figure 18:
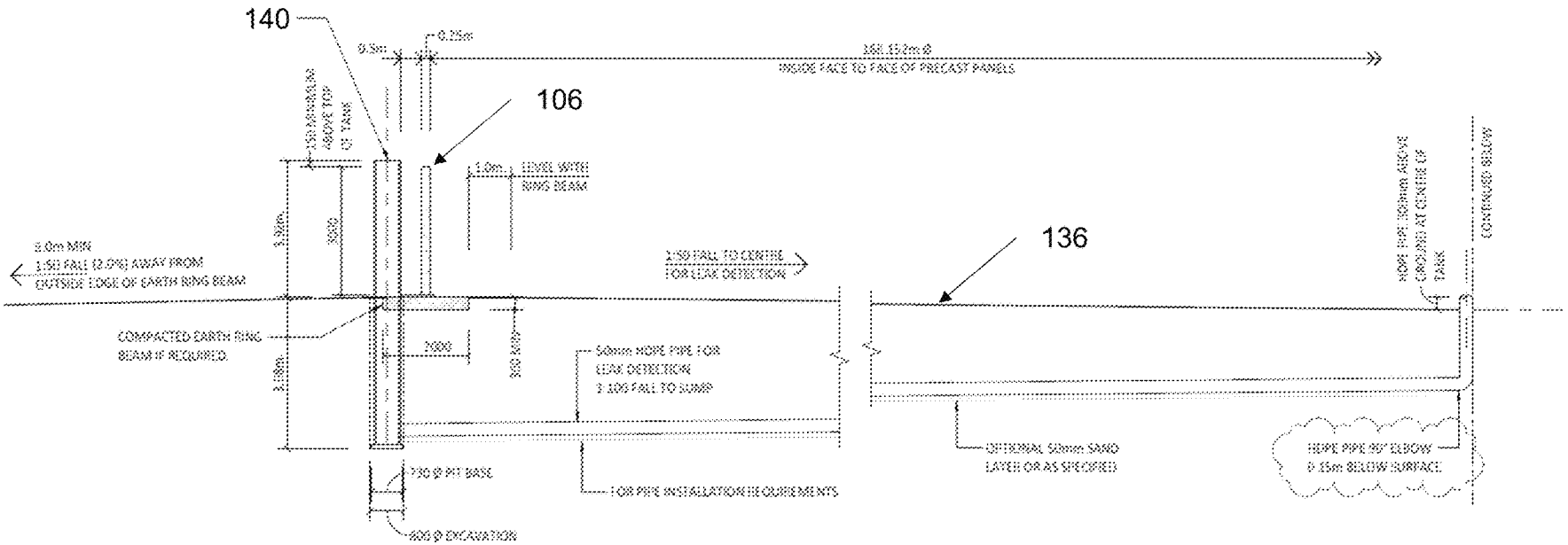
FIG. 18 illustrates a diagrammatic cross-sectional view of a leak detection system of the relocatable tank.

With reference to FIG. 14, the plurality of wall panels 104 are erected on a prepared earthen pad 139, such as levelled and compacted earthen ring beam. In preferred embodiments, the relocatable tank 100 further comprises at least one liner 134 installed inside the tank structure and configured to fluidly seal the wall panels 104 and a floor 136 of the relocatable tank. In some embodiments, the liner is in the form of a double liner as described in further detail with reference to FIG. 19. The liner 134 is secured on top of the wall panels 104 via capping or battens 135. In some embodiments, water tube ballast 154 is installed to ameliorate the concern of security of the liner 134. For example, if the tank has insufficient liquid the liner 134 may be disturbed or dislodged from the tank 100 by wind or other action on the tank 100.

Figure 19:
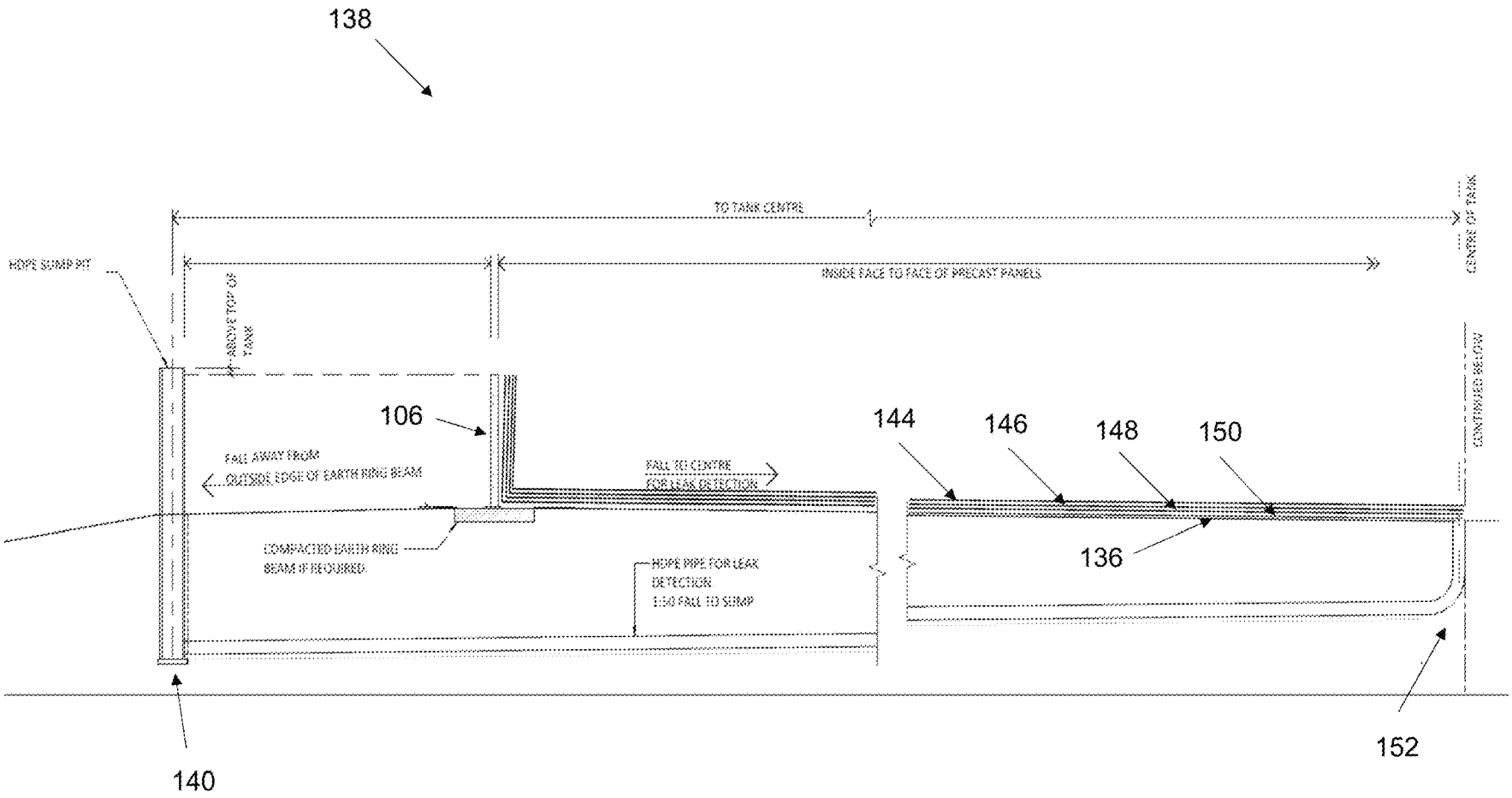
FIG. 19 is a cross sectional view of a leak detection system of the relocatable tank.

With reference to FIG. 19, in preferred embodiments, the relocatable tank 100 further comprises a leak detection system 138. In some embodiments, the leak detection system comprises a leak detection layer fluidly connected to an outlet 140. The outlet can be in the form of an external sump 140 located outside the tank 100 having a height greater than the continuous wall 106 with a pump 142 configured to return fluid from the sump 140 back into the relocatable tank 100 or discharged elsewhere.

In some embodiments, the leak detection system 138 comprises a primary liner 144, a cushioning layer 150 then a geonet layer 146. In some embodiments, a leak detection (secondary) liner 148 is also provided. In some embodiments, the cushioning layer 150 may be in the form of a geotextile. Other permutations of these layers can be implemented depending on the size and/or purpose of the tank. An internal sump 152 is fluidly connected to the leak detection liner 148 which is in turn fluidly connected to the outlet 140 in the form of an external sump having a communication system to transmit a signal indicating detection of a leak. The sumps 140, 152 may also have a pump (not shown) to return leaked fluid back into tank 100. In the event of a leak in the primary liner 144, fluid enters a geonet cavity formed by the geonet layer 146 and is caught by the leak detection liner 148 whereby it can flow into the sump and back into the tank 100. Water from the internal sump 148 is preferably gravity fed to the external sump 140 which can activate a pump, preferably a solar pump, to return water to the tank 100.

In preferred embodiments, the relocatable tank 100 can further comprise a ballast system comprising one or more water ballast tubes 154 inside the perimeter of the tank to retain the at least one liner 134, for example, when there is insufficient liquid in the tank to do so. The ballast system can comprise one or more perimeter water ballast tubes 154A and one or more radial water ballast tubes 154B secured by ropes and swages. Each water ballast tube 154 is a long cylindrical tube comprising water that provides sufficient mass to secure the liner 134 in the event the tank 100 is empty.

In some embodiments, a portion of the floor 136 of the tank inside the perimeter of the tank slopes towards the wall 106 of the tank from a hinge point, beyond which the floor 136 slopes towards the centre of the tank. In particular, the foundation is prepared in such a way that there is a fall towards the continuous wall 106 of the tank offset approximately 1-2 m that prevents the perimeter water ballast tube 154A from rolling towards the centre of the tank 100. As the size of the tank increases the water tube ballast system may consist of perimeter water tube ballast and additional water tube ballast secured in and around the centre of the tank. In preferred embodiments, water is used as the ballast material because it floats when the tank has liquid inside keeping the tube off the liner preventing rubbing. Also, if the ballast tube is compromised and the water leaks into the tank the impact is minimal whereas the opposite is true if, for example, sand is used as the ballast material.

In some embodiments, the relocatable tank 100 comprises an overflow arrangement 156, such as a weir situated near the top of one of the wall panels 104 of the continuous wall 106.

In some embodiments, the relocatable tank 100 comprises a floating cover (not shown) to prevent evaporation of the liquid in the tank 100. The cover floats on the surface of the liquid and rises and falls with the level of the liquid.

FIGS. 15 to 18 show details of pipework for the leak detection system 138 including the internal sump 148, inlet pipework 158, outlet pipework 160 and the outlet 140 in the form of the external sump.

In some embodiments, the relocatable tank 100 comprises a concrete pad 162 upon which a viewing platform 164 is constructed to enable observation of the interior of the tank.

In another form, there is provided a method of assembling a tank 100 on a site. The method comprises the step of erecting a plurality of support members 102 in a spaced apart configuration along a perimeter of the tank 100. As described herein, at least some of the support members 102 comprise at least one aperture 112 and/or at least one elongate slot 126A-D.

The method comprises the step of erecting a plurality of precast wall panels 104 between and received at least partially within the plurality of support members 102 to form a continuous wall 106 along the perimeter of the tank.

The method comprises the step of substantially surrounding an outside of the continuous wall 106 with a plurality of cables 110 of a tensioning system received within the at least one aperture 112 and/or the at least one elongate slot 126A-D of the support members 102 to retain a shape of the tank 100.

Advantageously, the relocatable tank 100 can be constructed quickly and relatively cost effectively at a site in a modular and adaptable manner. It can be a temporary or permanent installation with casting of the panels performed off-site. Waste liquids, such as effluent or industrial wastes, can then be stored in the relocatable tank 100. The structure of the tank can also be readily disassembled. The main structural components, namely the precast concrete panels 104 and support members 102 (standard posts and tensioning posts) can be reused to construct a new tank in the same location or elsewhere. The tank size can be either the same or altered with the subtraction or addition of these main components.

Once tanks according to the present invention are disassembled and materials removed from the site, due to use of an earthen foundation instead of concrete, the tank foundation area can be readily remediated and revegetated.

As the relocatable tank 100 is an engineered structure with multiple lining arrangements there are several advantages over earthen dams, which require heavy civil design and construction with significant impact to the foundation area making it much harder to remediate. Also, the environmental review and approval is typically much longer, especially for leak detection and prevention requirements. The tank of the present invention can include multiple layered systems for enhanced defect detection prior to use (using conductive geo fabric intermediate layers) and leak detection devices during use.

The leak detection system installed is uniquely arranged such that it operates as a closed loop system. The collection sump 140 installed external to the tank 100, which is taller than the tank wall 106, is connected via pipe to the lowest point in the tank sealed to the outermost liner. If there is a leak through one of the previous liners the liquid is drained to the sump. Either the liquid can remain here, or a pump can return the liquid to the tank 100. Since the sump 140 cannot overflow being taller than the tank 100 no liquid is lost or discharged to the environment. Simple devices can be deployed to detect liquid in the sump hence identifying a leak and where a pump is utilized the flowrate can be used to determine the severity of the leak.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

As used herein, an element or operation recited in the singular and proceeded with the word "a" or "an" should be understood as not excluding plural elements or operations, unless such exclusion is explicitly recited. Furthermore, references to "one embodiment" of the present disclosure are not intended to be interpreted as excluding the existence of additional embodiments that also incorporate the recited features.

In this specification, the terms 'comprises', 'comprising', 'includes', 'including', or similar terms are intended to mean a non-exclusive inclusion, such that a method, system or apparatus that comprises a list of elements does not include those elements solely but may well include other elements not listed.

The invention claimed is:

1. A relocatable tank comprising:

a plurality of free-standing steel support members arrangeable in a spaced apart configuration along a perimeter of the tank, wherein each free-standing support member comprises an I-beam attached to a base portion, wherein the base portion of each support member is placed on a prepared earthen pad without the need for a concrete foundation;

a plurality of substantially planar precast concrete wall panels arrangeable between, and received at least partially within the plurality of support members to form a continuous wall along the perimeter of the tank; and a tensioning system comprising a plurality of cables configured to extend around an outside of the continuous wall;

wherein at least some of the support members comprise at least one aperture and at least one elongate slot to receive respective cables of the tensioning system to retain a shape of the tank;

wherein at least some of the support members are tensioning support members and the tensioning support members are provided in pairs periodically around the perimeter of the tank; and wherein the cables are passed through the apertures in the tensioning support members and retained and tensioned on one side of each of the tensioning support members in an alternating sequence.

2. The relocatable tank of claim 1, wherein the wall panels have side walls at a transverse angle to the plane of the panel.

3. The relocatable tank of claim 1, wherein the wall panels comprise side walls are angled in opposite directions to form an isosceles trapezoid in a cross-section of the wall panel.

4. The relocatable tank of claim 1, wherein at least some of the support members comprise standard support members.

5. The relocatable tank of claim 1, wherein the I-beam comprises a central portion and substantially perpendicular flanges coupled to ends of the central portion, wherein the wall panels are received between the flanges of the I-beam.

6. The relocatable tank of claim 1, wherein the tensioning support members comprise at least one aperture in the central portion thereof and at least one elongate slot in the central portion thereof.

7. The relocatable tank of claim 6, wherein the at least one elongate slot comprises a channel extending into at least one of the substantially perpendicular flanges to receive a cable therein.

8. The relocatable tank of claim 1, wherein the tensioning support members comprise a plurality of apertures in the central portion thereof and a plurality of elongate slots below said apertures.

9. The relocatable tank of claim 8, wherein the tensioning support members comprise a plurality of elongate slots above said apertures, said elongate slots below said apertures being of a greater depth than the elongate slots above the apertures.

10. The relocatable tank of claim 1, wherein the apertures in a first type of the tensioning support member are vertically offset with respect to the apertures in a second type of the tensioning support member.

11. The relocatable tank of claim 1, wherein a plurality of cables collectively extends around the continuous wall.

12. The relocatable tank of claim 11, wherein the tensioning cables are in greater concentration towards the base of the panels, or in a lower portion of the panels.

13. The relocatable tank of claim 4, wherein at least one of the tensioning support members is provided for at least every quarter of a circular tank.

14. The relocatable tank of claim 4, wherein at least one of the tensioning support members and at least one of the standard support members are provided in a group periodically around a perimeter of a circular tank.

15. The relocatable tank of claim 4, wherein at least two of the tensioning support members and at least two of the standard support members are provided in a group periodically around a perimeter of a circular tank.

16. The relocatable tank of claim 1, wherein at least one cable anchor or at least one retention bar is provided to retain one or more of the cables at the support members.

17. The relocatable tank of claim 1, wherein a first type of the tensioning support member comprises a plurality of spaced apart cable anchors which are vertically offset with respect to a plurality of spaced apart cable anchors of a second type of the tensioning support member.

18. The relocatable tank of claim 1, further comprising at least one liner configured to fluidly seal the wall panels and a floor of the relocatable tank.

19. The relocatable tank of claim 18, wherein the tank comprises a double liner and a leak detection system.

20. The relocatable tank of claim 19, wherein the leak detection system comprises a leak detection layer fluidly connected to an outlet.

21. The relocatable tank of claim 20, wherein the outlet is a sump having a height greater than the continuous wall with a pump configured to return fluid from the sump back into the relocatable tank or discharged elsewhere.

22. The relocatable tank of claim 18, further comprising one or more water ballast tubes inside the perimeter of the tank to retain the at least one liner when there is insufficient liquid in the tank to do so.

23. The relocatable tank of claim 18, wherein a portion of a surface of the floor of the tank inside the perimeter of the tank slopes towards the wall of the tank.

24. The relocatable tank of claim 1, further comprising an overflow arrangement situated near the top of one of the panels.

25. The relocatable tank of claim 1, further comprising a floating cover.

26. A method of assembling a relocatable tank on a site, the method comprising the steps of:

erecting a plurality of free-standing steel support members in a spaced apart configuration along a perimeter of the tank, wherein each free-standing support member comprises an I-beam attached to a base portion and the base portion of each support member is placed on a prepared earthen pad without the need for a concrete foundation, and wherein at least some of the support members comprise at least one aperture and at least one elongate slot;

erecting a plurality of precast concrete wall panels between, and received at least partially within the plurality of support members to form a continuous wall along the perimeter of the tank; and substantially surrounding an outside of the continuous wall with a plurality of cables of a tensioning system received within the at least one aperture and/or the at least one elongate slot of the support members to retain a shape of the tank;

providing at least some of the support members in the form of tensioning support members in pairs periodically around the perimeter of the tank;

passing the cables through the apertures in the tensioning support members; and retaining and tensioning the cables on one side of each of the tensioning support members in an alternating sequence.

27. The method of claim 26, wherein the tank comprises one or more of the following:

the support members comprise at least some standard support members;

the I-beam comprises a central portion and substantially perpendicular flanges coupled to ends of the central portion, wherein the wall panels are received between the flanges of the I-beam;

the tensioning support members comprise at least one aperture in the central portion thereof and at least one elongate slot in the central portion thereof;

the at least one elongate slot comprises a channel extending into at least one of the substantially perpendicular flanges to receive a cable therein;

the tensioning support members comprise a plurality of apertures in the central portion thereof and a plurality of elongate slots below said apertures;

the tensioning support members comprise a plurality of elongate slots above said apertures, said elongate slots below said apertures being of a greater depth than the elongate slots above the apertures;

the apertures in a first type of the tensioning support member are vertically offset with respect to the apertures in a second type of the tensioning support member;

a plurality of cables collectively extends around the continuous wall;

the tensioning cables are in greater concentration towards the base of the panels, or in a lower portion of the panels;

at least one of the tensioning support members is provided for at least every quarter of a circular tank;

at least one of the tensioning support members and at least one of the standard support members are provided in a group periodically around a perimeter of a circular tank;

at least two of the tensioning support members and at least two of the standard support members are provided in a group periodically around a perimeter of a circular tank;

at least one cable anchor or at least one retention bar is provided to retain one or more of the cables at the support members;

a first type of the tensioning support member comprises a plurality of spaced apart cable anchors which are vertically offset with respect to a plurality of spaced apart cable anchors of a second type of the tensioning support member.

* * * * *